US010548369B2

(12) United States Patent
Nakaya et al.

(10) Patent No.: US 10,548,369 B2
(45) Date of Patent: Feb. 4, 2020

(54) SHOE SOLE

(71) Applicant: ASICS CORPORATION, Kobe-shi, Hyogo (JP)

(72) Inventors: Seigo Nakaya, Kobe (JP); Masaru Ichikawa, Kobe (JP); Yoshiyasu Ando, Kobe (JP); Satoru Abe, Kobe (JP)

(73) Assignee: ASICS CORPORATION, Kobe-shi, Hyogo (JP)

( * ) Notice: Subject to any disclaimer, the term of this patent is extended or adjusted under 35 U.S.C. 154(b) by 5 days.

(21) Appl. No.: 15/303,006

(22) PCT Filed: Apr. 11, 2014

(86) PCT No.: PCT/JP2014/060542
§ 371 (c)(1),
(2) Date: Oct. 9, 2016

(87) PCT Pub. No.: WO2015/155897
PCT Pub. Date: Oct. 15, 2015

(65) Prior Publication Data

US 2017/0042283 A1 Feb. 16, 2017

(51) Int. Cl.
*A43B 5/06* (2006.01)
*A43B 13/12* (2006.01)
(Continued)

(52) U.S. Cl.
CPC ..... *A43B 13/141* (2013.01); *A43B 5/06* (2013.01); *A43B 13/04* (2013.01); *A43B 13/122* (2013.01);
(Continued)

(58) Field of Classification Search
CPC ..... A43B 5/06; A43B 13/14; A43B 13/141; A43B 13/122; A43B 13/181; A43B 3/248
(Continued)

(56) References Cited

U.S. PATENT DOCUMENTS 5,915,820 A 6/1999 Kraeuter et al.
6,021,588 A * 2/2000 Alviso ..... A43B 3/128 36/102
(Continued)

FOREIGN PATENT DOCUMENTS

JP 2000-516509 A 12/2000
JP 2013-46667 A 3/2013
(Continued)

*Primary Examiner* — Sharon M Prange
(74) *Attorney, Agent, or Firm* — Muncy, Geissler, Olds & Lowe, P.C.

(57) ABSTRACT

A shoe sole which has a landing surface composed of three regions of a middle-sole region, a fore-sole region and a rear-sole region, and has a plurality of groove portions in the landing surface. The groove portions include: a first groove portion located in the fore-sole region, on a first imaginary line extending along the MP joint; a second groove portion located in the fore-sole region, on a second imaginary line extending along a line which connects a medial outer edge of the fore-sole region and a lateral outer edge of the middle-sole region with each other, in an area which is closer to a toe than to the first groove portion; and a third groove portion located in the rear-sole region, on a third imaginary line extending along a line which connects a medial outer edge of the rear-sole region and a lateral outer edge of the middle-sole region with each other.

19 Claims, 21 Drawing Sheets

(51) Int. Cl.
*A43B 13/14* (2006.01)
*A43B 13/04* (2006.01)
*A43B 13/18* (2006.01)

(52) U.S. Cl.
CPC ..... *A43B 13/14* (2013.01); *A43B 13/181* (2013.01); *A43B 13/187* (2013.01)

(58) Field of Classification Search
USPC ..... 36/25 R, 30 R, 102, 103
See application file for complete search history.

(56) References Cited

U.S. PATENT DOCUMENTS 6,065,230 A * 5/2000 James ..... A43B 3/0057 36/25 R
6,964,120 B2 * 11/2005 Cartier ..... A43B 13/12 36/28
7,946,058 B2 * 5/2011 Johnson ..... A43B 3/0057 36/102
9,402,438 B2 * 8/2016 Shakoor ..... A43B 13/141
2010/0115796 A1 * 5/2010 Pulli ..... A43B 13/141 36/103
2010/0293816 A1 * 11/2010 Truelsen ..... A43B 5/06 36/30 R
2011/0185590 A1 8/2011 Nishiwaki et al.
2012/0317844 A1 * 12/2012 Vattes ..... A43B 7/142 36/25 R
2015/0089841 A1 * 4/2015 Smaldone ..... A43B 5/00 36/103
2015/0135558 A1 5/2015 Inomata et al.
2015/0250260 A1 * 9/2015 Bessho ..... A43B 13/122 36/25 R

FOREIGN PATENT DOCUMENTS

JP 5190565 B 4/2013
WO 2010/038266 A1 4/2010
WO 2013/168259 A1 11/2013

* cited by examiner

SHOE SOLE

TECHNICAL FIELD

The present invention relates to shoe soles, and more specifically, to a shoe sole which allows for natural movement of the foot, prevents excessive deformation (pronation) thereof, and relieves physical burden onto the human body.

BACKGROUND ART

Since human feet include an assembly of a large number of bones each having a very complicated shape, very complicated deformation (pronation) occurs during activities. This excessive pronation can be a cause of problems not only of the feet but also of the ankles and the knees. For this reason, a number of shoes feature use of high-hardness materials inside their midsoles, resin parts in middle-sole regions, or other arrangements incorporated in the shoes in an attempt to restrain the deformation.

On the other hand, however, too much restraint onto the deformation limits natural functions of the foot, and there is an argument that such a restraint can inhibit forward weight transfer, and in addition, decrease foot functions.

In an effort to allow for natural movement of the foot, many shoes have their shoe soles provided with various kinds of flexion grooves. Representative examples in recent years include "Nike Free" which was released from Nike Japan, Inc., and "Five Fingers" from Vibram. Both of them and many others claim that they offer natural movement of the foot and/or bare-foot feeling as their features, and a very wide variety of bare-foot feeling shoes are available in the market.

The bare-foot feeling shoes feature an increased number of grooves in the shoe sole for improved flexibility, maximum weight reduction, and so on.

In pursuit of the bare-foot feeling, excessive weight reduction and/or too much flexion can lead to a problem that such a pair of shoes cannot withstand a range of load expected from running activities performed in a normal pair of running shoes, and so the runner must change his/her landing pattern and/or fundamental running form.

However, majority of runners are heel strike runners, and for this reason, it is difficult for him/her to use bare-foot feeling shoes as their second pair of shoes after their first-choice pair of shoes.

So, there is a demand for bare-foot feeling shoes in which runners can run in their natural running forms without changing their normal forms.

Also found in the market are light-weighted shoes having their shoe soles formed with diagonal grooves for restrained eversion of the heel and increased shock absorption in the heel (see Patent Literature 1).

CITATION LIST

Patent Literature

Patent Literature 1: JP-B No. 5190565

SUMMARY OF INVENTION

Technical Problem

Patent Literature 1 listed above, does not include any consideration into actual shoe sole deformation during a running process from the time when the foot strikes the ground surface to the time when it leaves the ground surface during running activities.

Therefore, an object of the present invention is to provide a shoe sole based on considerations into the actual shoe sole deformation during a running process from the time when the foot strikes the ground surface to the time when it leaves the ground surface, capable of allowing for natural movement of the foot, of preventing excessive pronation and of reducing physical burden onto the human body.

Solution to Problem

The present invention provides a shoe sole which has a landing surface composed of three regions of a middle-sole region, a fore-sole region and a rear-sole region, and has a plurality of groove portions in the landing surface. In this shoe sole, the groove portions include: a first groove portion located in the fore-sole region, on a first imaginary line extending along the MP joint; a second groove portion located in the fore-sole region, on a second imaginary line extending along a line which connects a medial outer edge of the fore-sole region and a lateral outer edge of the middle-sole region with each other, in an area which is closer to a toe than to the first groove portion; and a third groove portion located in the rear-sole region, on a third imaginary line extending along a line which connects a medial outer edge of the rear-sole region and a lateral outer edge of the middle-sole region with each other. With the above arrangement, the second groove portion has the largest average depth of all average depths of other grooves disposed in the fore-sole region; and the third groove portion has the largest average depth of all average depths of other grooves disposed in the rear-sole region.

With the above, the first groove portion has an average depth which is smaller than that of the second groove portion but larger than average depths of the other grooves disposed in the fore-sole region.

Further, the second imaginary line crosses the medial outer edge at an intersection located in a range from the head of first metatarsal bone to the toe tip, and crosses the lateral outer edge at an intersection located in a range from the tuberosity of fifth metatarsal bone to the head of fifth metatarsal bone, whereas the third imaginary line crosses the medial outer edge at an intersection located in a range of the subtalar lower joint; and crosses the lateral outer edge at an intersection located in a range from the tuberosity of fifth metatarsal bone to the subtalar lower joint heel-side end region.

Also, there may be an arrangement that the depth of the second groove portion to a thickness of the shoe sole has a greater ratio than a ratio of the depth of the third groove portion to the thickness of the shoe sole.

Also, there may be an arrangement that the ratio of the depth of the second groove portion to the thickness of the shoe sole is not smaller than the ratio of the depth of the first groove portion to the thickness of the shoe sole.

Also, the shoe sole may have an upper surface on a side away from the landing surface, in which the shoe sole further has groove portions in the upper surface, at locations opposed to the first groove portion and to the second groove portion.

Also, there may be an arrangement that the third groove portion is deeper on its medial side than on its lateral side, or the third groove portion is shallower near a medial outer circumferential end and near a lateral outer circumferential end than near its center.

Also, the shoe sole may further have a first assist groove portion located in the rear-sole region, on a side closer to the heel portion than to the above-described third groove portion, in parallel with the third groove portion.

Also, the shoe sole may further have a second assist groove portion located on the second imaginary line, in an area closer to the heel portion than to the first groove portion.

Also, the shoe sole may further have a third assist groove portion located in the fore-sole region and extending from the lateral outer edge of the fore-sole region toward a center area of the shoe.

Also, the thickness of the heel portion may be increasingly thinner in an obliquely outer direction in a plan view.

Advantageous Effects of Invention

The above-described shoe sole is capable of following natural movement of the foot while restraining excessive pronation.

DESCRIPTION OF EMBODIMENTS

Hereinafter, shoe soles according to embodiments of the present invention will be described in detail with reference to the drawings.

Figure 1:
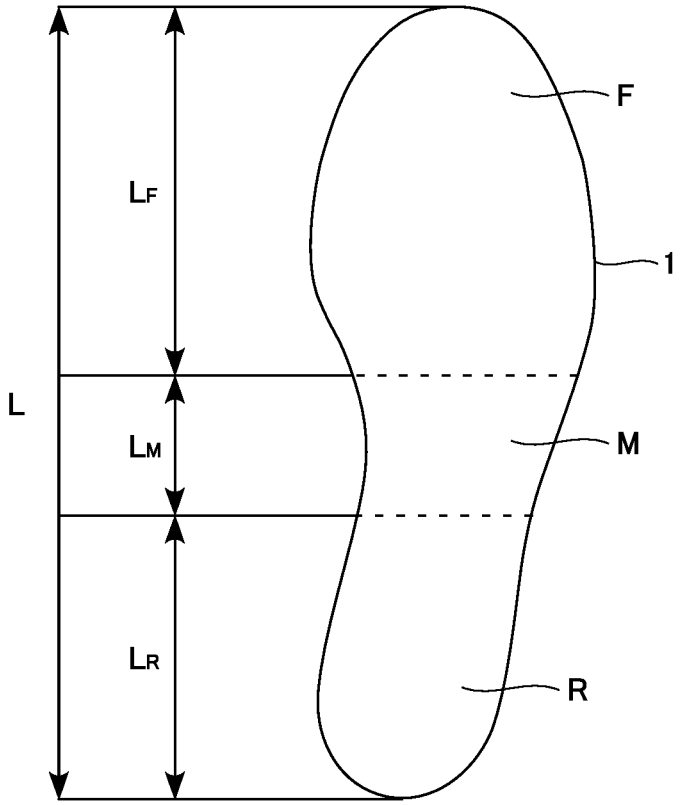
FIG. 1 is an explanatory view which shows a fore-sole region, a middle-sole region and a rear-sole region of a shoe sole according to a first embodiment of the present invention.

In the shoe soles according to the embodiments, the term "fore-sole region F" refers to a forward region of the shoe sole as shown in FIG. 1, i.e., a region which has a length $L_F$ with respect to a total length L of the shoe sole. Likewise, the term "middle-sole region M" refers to a central region of the shoe sole which has a length $L_M$ with respect to the total length L of the shoe sole; and the term "rear-sole region R" refers to a rear region of the shoe sole which has a length $L_R$ with respect to the total length L of the shoe sole. The ratio of the length of each region is expressed in:

$$L_F:L_M:L_R=2.6:1:1.9 \text{ (where } L=L_F+L_M+L_R)$$

The inventor et al. of the present invention shared a recognition that in order for bare-foot feeling shoes to allow running in natural form without requiring change in landing pattern and/or running form, it is important that a locus of the center of pressure (hereinafter called COP) found in a foot sole when running in the shoes is as close to a COP found in bare foot running on a soft load surface provided by sponge for example. From this recognition, arrangements in the shoe sole according to the present invention were found.

Conventional bare-foot feeling shoes described earlier have a large number of flexion grooves over the entire shoe sole (hereinafter, simply called sole), and this allows the sole to easily respond foot deformations at each moment in a support period. A potential problem, however, is that too much decrease in sole rigidity will lead to excessive pronation, resulting in increased physical burden onto the human body.

So, the inventor et al. conducted a research into behavior of feet. The research was made by using shoes which had a simple arrangement that the midsole was very thin as compared to normal running shoes, and there were no diagonal grooves. Three runners, each having a different pronation type from the other two, wore the shoes and performed running at a pace of 5 minutes/km.

Markers were attached around the sole, and their coordinates during the running were tracked in a three-dimensional fashion using a motion capture system, in order to assess shoes deformation state in each support period.

More specifically, the deformation state was observed by dividing a sole 1 as shown in FIG. 1, into three regions of the fore-sole region F, the middle-sole region M and the rear-sole region R, and calculation was made to find an axis of the largest flexion (hereinafter called main flexion axis) in each region, based on the measured coordinate values.

Figure 2A:
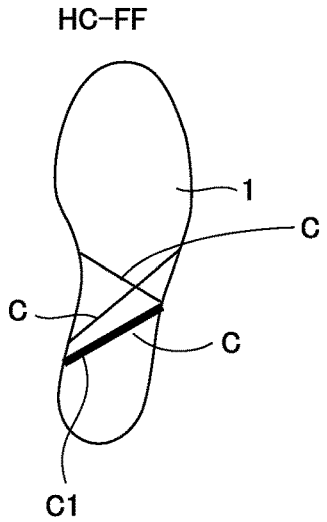
FIG. 2A is an explanatory view which shows main flexion axes of the shoe sole according to the first embodiment of the present invention, in a support period (Stage HC-FF).
Figure 2B:
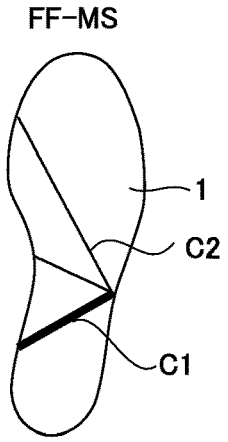
FIG. 2B is an explanatory view which shows main flexion axes of the shoe sole according to the first embodiment of the present invention, in a support period (Stage FF-MS).
Figure 2C:
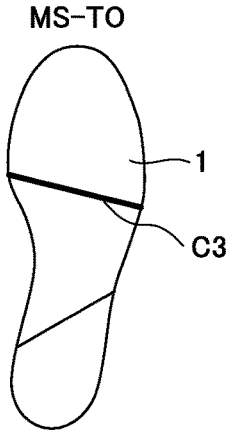
FIG. 2C is an explanatory view which shows main flexion axes of the shoe sole according to the first embodiment of the present invention, in a support period (Stage MS-TO).

FIG. 2A through FIG. 2C show the main flexion axes C in each region of the sole in each stage of the support period. Each line in the figures correspond to the each region defined in FIG. 1, and a thickness of the line indicates how large the flexing angle was. Hereinafter, heel contact will be abbreviated as HC, full-sole contact will be abbreviated as FF, middle of the support period will be abbreviated as MS, heel rising will be abbreviated as HR, and toe taking off will be abbreviated as TO.

FIG. 2A shows calculated main flexion axes C in a state from HC to FF, FIG. 2B shows those in a state from FF to MS, and FIG. 2C shows those in a state from MS to TO.

First, right after landing, i.e., during the phase from heel contact (HC) to the full-sole contact (FF), the research found that as shown in FIG. 2A, there was a large flexion at a location which connects an inner side (a medial side) of the rear-sole region to an outer side (a lateral side) of the middle-sole region. This may be because the runner lands on his/her lateral side of the rear-sole region first, in running. The main flexion axis at the location which connects the medial side of the rear-sole region to the lateral side of the middle-sole region will be called C1.

Next, in an intermediate phase of the support period, i.e., in the phase from full-sole contact (FF) to middle of the support period (MS), large flexions were found as shown in FIG. 2B, at the above described position, which connects the medial side of the rear-sole region to the lateral side of the middle-sole region, and at a position which connects the medial side of the fore-sole region to the lateral side of the middle-sole region. This can be understood as caused by pronation in the middle phase of the support period, which led to deformation of the medial longitudinal arch of foot and a load shift to a medial side of the sole. The main flexion axis at the location which connects the medial side of the fore-sole region to the lateral side of the middle-sole region will be called C2.

Lastly, in the latter phase of the support period, i.e., in the phase from middle of the support period (MS) through heel rising (HR) and toe taking off (TO), a large flexing was found as shown in FIG. 2C, at a location near the MP joint. The main flexion axis near the MP joint will be called C3.

Figure 13:
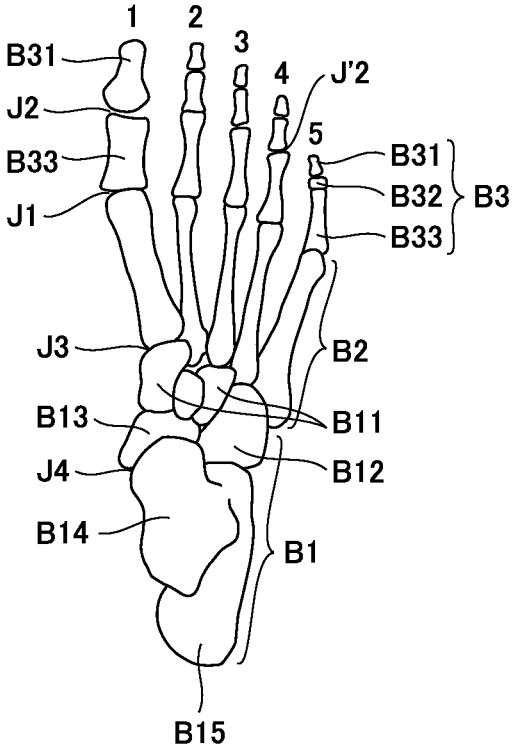
FIG. 13 is a plan view which shows a foot skeleton.

FIG. 13 is a plan view which shows a foot skeleton. The foot includes tarsus B1, the first through the fifth metatarsals B2, and phalanx B3. The tarsus B1 includes cuneiform B11, cuboid B12, navicular B13, talus B14 and calcaneus B15. The phalanx B3 includes proximal phalanx B33, middle phalanx B32 and distal phalanx B31. FIG. 13 shows, starting from the left, the first, the second, the third, the fourth and the fifth ones. The foot joints include IP joint J2, PIP joint J'2, MP joint J1, Lisfranc joint J3 and Chopart joint J4. Here, the above-described main flexion axes in each phase of the support period will be defined with reference to the foot skeleton.

The main flexion axis C1 right after landing is in the rear-sole region, representing a line which connects an inner side (a medial side) of the rear-sole region to an outer side (a lateral side) of the middle-sole region.

In the intermediate phase of the support period, one more line is added to the main flexion axis C1, i.e., a line which connects a medial side of the fore-sole region to a lateral side of the middle-sole region, represents the main flexion axis C2.

In the latter phase of the support period, a line near the MP joint J1 represents the main flexion axis C3.

Figure 5:
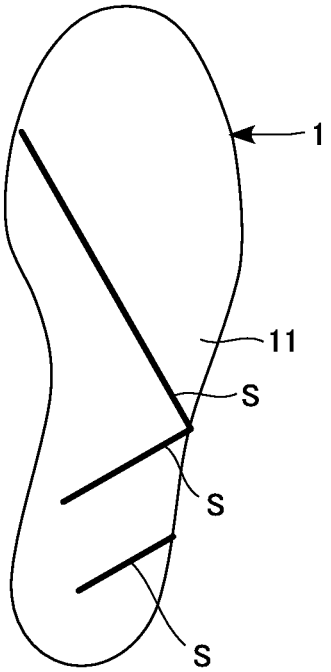
FIG. 5 is an explanatory view which shows a test sample formed with a slit on a first line which connects a medial outer edge in the fore-sole region and a lateral outer edge in the middle-sole region; a slit on a second line which connects a medial outer edge in the rear-sole region and a lateral outer edge in the middle-sole region; and a slit on a line drawn behind the second line in parallel thereto; as opposed to the shoe which has an outer sole without any design.
Figure 6:
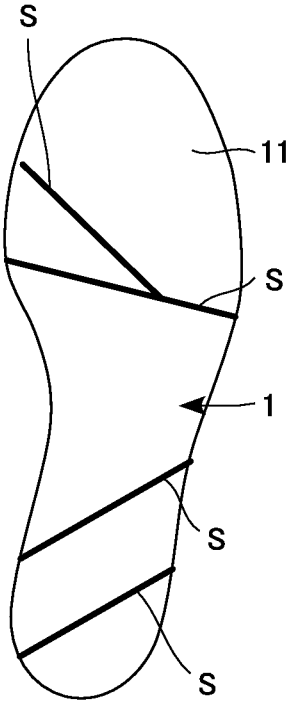
FIG. 6 is an explanatory view which shows a test sample formed with a slit on a first line which extends along the MP joint; a slit on a second line which connects a medial outer edge in the fore-sole region and a lateral outer edge in the middle-sole region; a slit on a third line which extends along a line that connects a medial outer edge in the rear-sole region and a lateral outer edge in the middle-sole region; and a slit on a line drawn behind the third line in parallel thereto; as opposed to the shoe which has an outer sole without any design.
Figure 7:
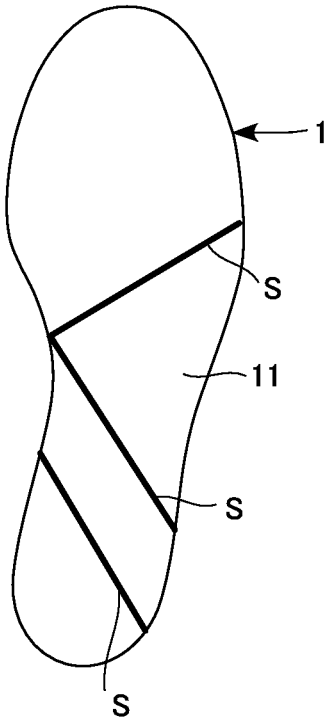
FIG. 7 is an explanatory view which shows a test sample formed with slits in a reversed pattern of the pattern in FIG. 5.

Based on the results obtained in the earlier-described experiment, test samples were made using shoes each having a sole 1 which includes an outer sole 11 without any design. To these, various slit patterns were made as shown in FIG. 5 through FIG. 7, and a running motion experiment was conducted.

Figure 3:
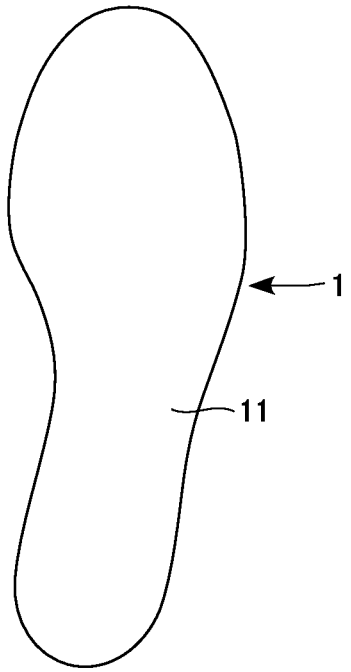
FIG. 3 is an explanatory view which shows a test sample of a shoe having an outer sole without any design.
Figure 4:
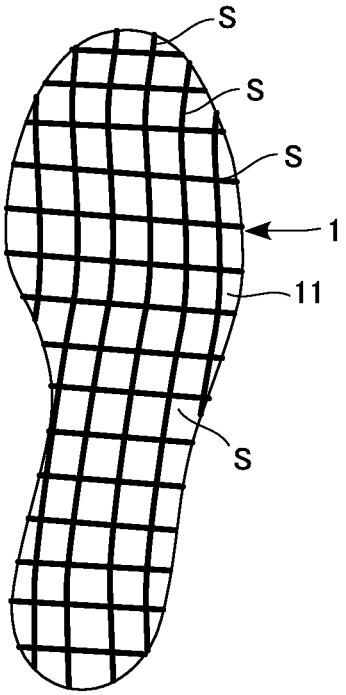
FIG. 4 is an explanatory view which shows a test sample with a large number of slits formed in a grid pattern, as opposed to the shoe which has an outer sole without any design.

FIG. 3 shows Type 1, in which the outer sole 11 had no slits; FIG. 4 shows Type 2 which had a large number of grid-like slits S; FIG. 5 shows Type 3 provided with slits S on a first line which connects a medial side of the fore-sole region to a lateral side of the middle-sole region, on a second line which connects a medial side of the rear-sole region to a lateral side of the middle-sole region, and on a third line which is drawn behind the second line in parallel thereto; FIG. 6 shows Type 4 which reflects the results described in the previous paragraph, i.e., which was provided with a slit S correspondingly to each of the main flexion axes; and FIG. 7 shows Type 5 which is a sample formed with slits S in a reversed pattern of the one in Type 3.

Figure 8:
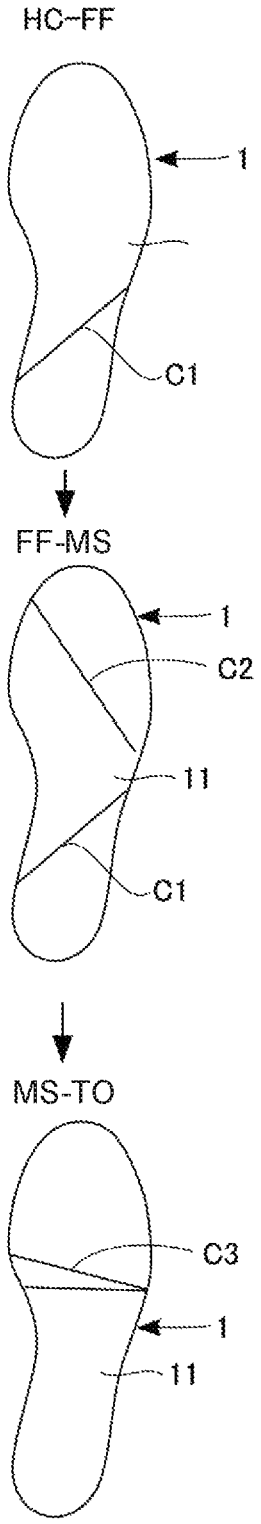
FIG. 8 is an explanatory view which shows main flexion axes when the test sample shown in FIG. 3 was subjected to a running motion experiment.
Figure 9:
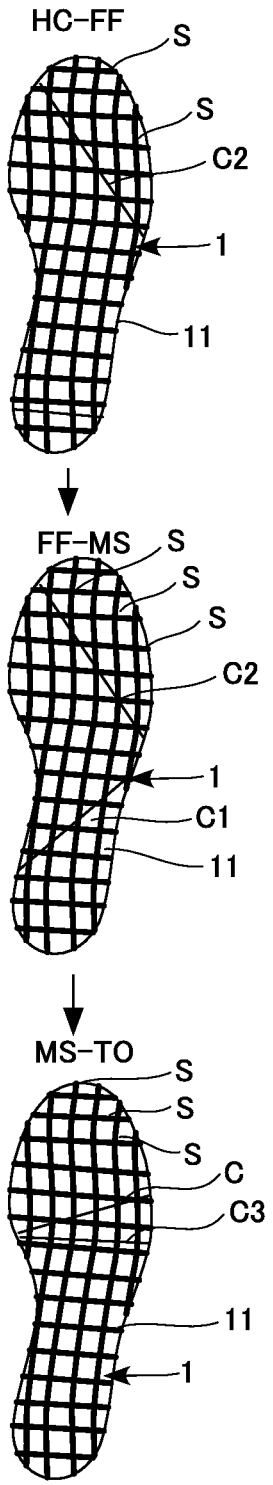
FIG. 9 is an explanatory view which shows main flexion axes when the test sample shown in FIG. 4 was subjected to a running motion experiment.
Figure 10:
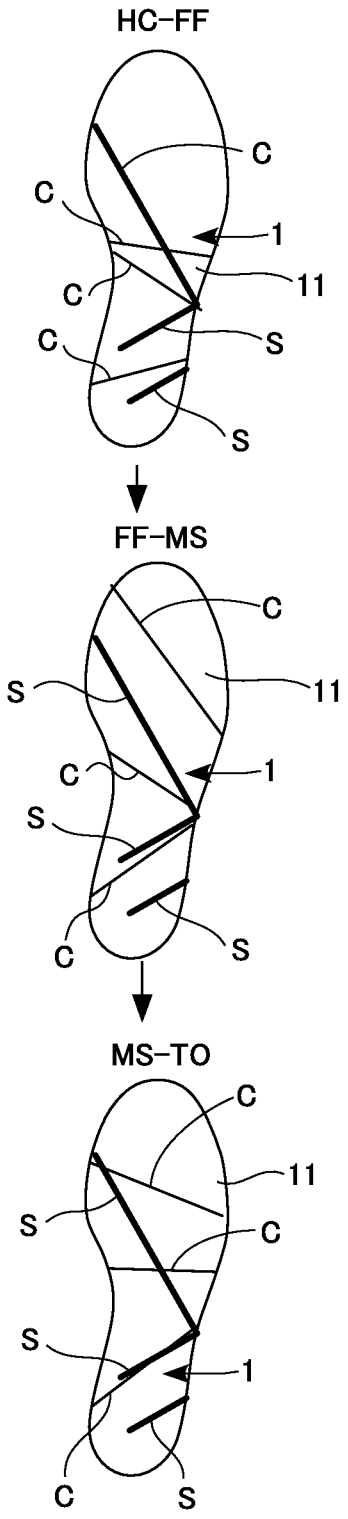
FIG. 10 is an explanatory view which shows main flexion axes when the test sample shown in FIG. 5 was subjected to a running motion experiment.
Figure 12:
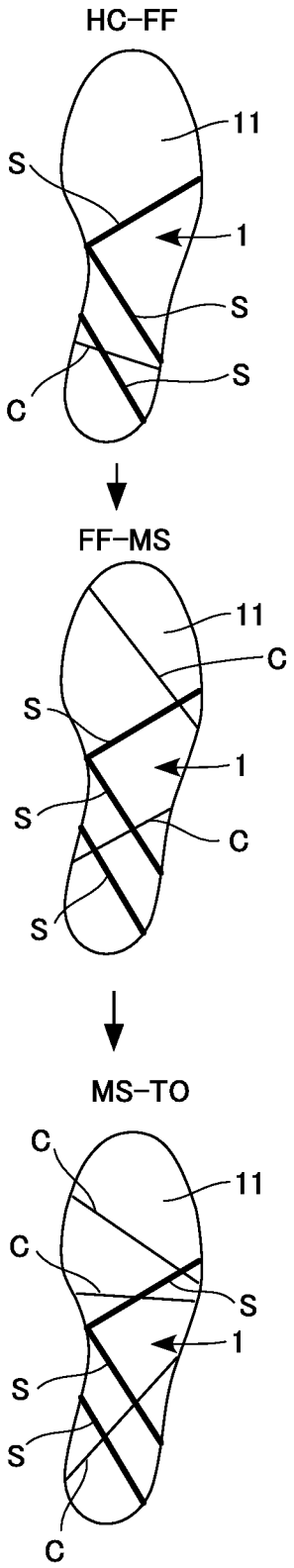
FIG. 12 is an explanatory view which shows main flexion axes when the test sample shown in FIG. 7 was subjected to a running motion experiment.

Here is a result: First, Type 1 which had no grooves showed main flexion axes C1 through C3 as illustrated in FIG. 8, or at the same locations as described earlier. Type 2 sample showed a pattern as illustrated in FIG. 9, Type 3 sample showed a pattern as illustrated in FIG. 10, Type 5 sample showed a pattern as illustrated in FIG. 12, or in other words, locations of the slits S were not at the places where the calculated main flexion axes C were located in each phase.

Figure 11:
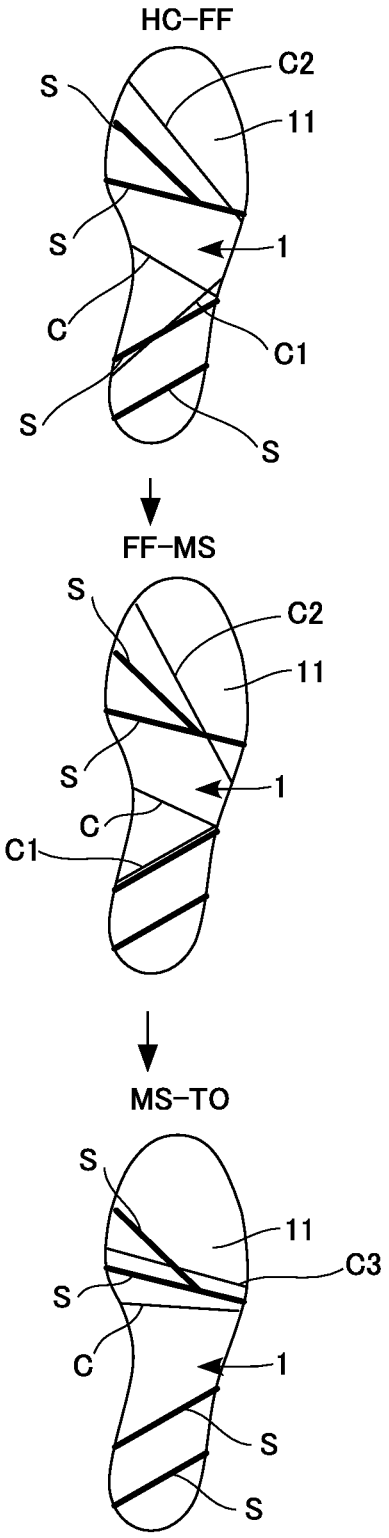
FIG. 11 is an explanatory view which shows main flexion axes when the test sample shown in FIG. 6 was subjected to a running motion experiment.

However, Type 4 sample, which reflects the results described earlier, showed a pattern as illustrated in FIG. 11, i.e., locations of the slits S were at the places where there were the calculated main flexion axes C. In other words, an arrangement like in Type 4 sample, in which flexion grooves are provided at locations of the main flexion axis found in each phase of the support period in each region of the shoe, will decrease a load onto the foot when the sole flexes.

The present invention is based on the demonstration described above, and provides a sole 1 formed with the following grooves.

Figure 14:
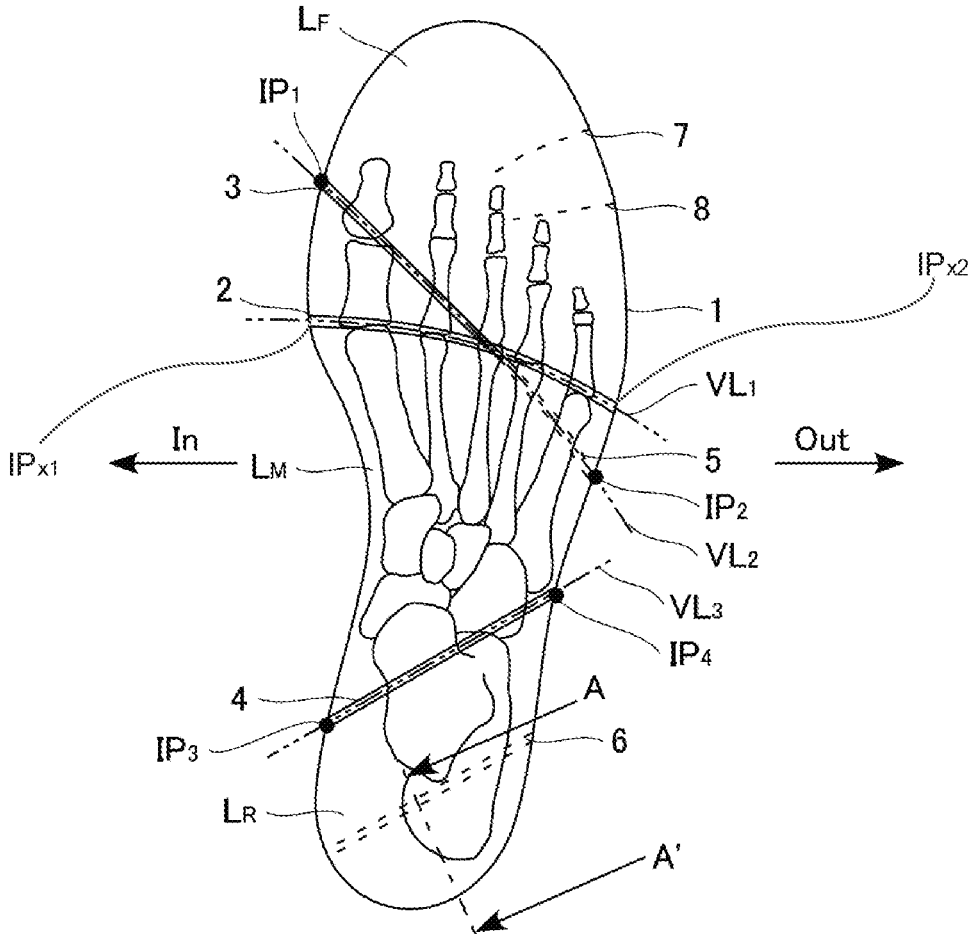
FIG. 14 is an explanatory view which shows a concept of the shoe sole according to the first embodiment of the present invention.

Specifically, as shown in FIG. 14, in the present invention, the sole 1 is formed with: a first groove portion 2 located in the fore-sole region, on a first imaginary line VL1 extending along metatarsal-phalangeal joints (or MP joints), The first groove portion is defined by an MP intersection ($IP_{x1}$) that is a spot where the extension of the first imaginary line intersects a medial area of the fore-side region and another MP intersection ($IP_{x2}$) that is a spot where the extension intersects a lateral area of the fore-side region; a second groove portion 3 located in the fore-sole region, on a second imaginary line VL2 extending along a line which connects an outer edge of a medial-side "In" of the fore-sole region and the outer edge of a lateral-side "Out" of the middle-sole region with each other, and reaching from the medial-side area of the fore-side region to at least the first groove portion 2; and a third groove portion 4 disposed in the rear-sole region, on a third imaginary line VL3 extending along a line which connects an outer edge of a medial-side "In" of the rear-sole region and an outer edge of a lateral-side "Out" of the middle-sole region with each other, and reaching from the medial area of the rear-sole region to a lateral area of the rear-sole region.

For formation of the groove portions more closely to the main flexion axes, preferably, the second imaginary line $VL_2$ crosses the outer edge of the medial-side "In" at an intersection $IP_1$ located in a range from the head of first metatarsal bone to the toe tip; and crosses the outer edge of the lateral-side "Out" at an intersection $IP_2$ located in a range from the tuberosity of fifth metatarsal bone to the head of fifth metatarsal bone. Also, the third imaginary line $VL_3$ crosses the outer edge of the medial-side "In" at an intersection $IP_3$ located in a range of the subtalar lower joint; and crosses the outer edge of the lateral-side "Out" at an intersection $IP_4$ located in a range from the tuberosity of fifth metatarsal bone to the subtalar lower joint heel-side end region.

With the above arrangement, the second groove portion 3 has the deepest average depth of all average depths in any of the grooves disposed in the fore-sole region F.

The first groove portion 2 has an average depth which is smaller than that of the second groove portion 3 but larger than average depths of the other grooves disposed in the fore-sole region F.

The third groove portion 4 has the deepest average depth of all average depths in any of the grooves disposed in the rear-sole region R.

At a minimum, in the sole according to the present embodiment, the above-described first groove portion 2, second groove portion 3 and third groove portion 4 are provided in the sole 1, and as described above, each of these groove portions has the deepest average depth of all average depths of the other groove portions located in the same region, whereby groove portions are provided at locations corresponding to the main flexion axes. This makes the sole easily flex with the foot while restraining excessive pronation.

In addition to the above arrangement, there may be disposed a first assist groove portion 6 correspondingly to the other main flexion axes in the other phases of support period, in parallel with the third groove portion 4, on a side closer to the heel portion than the above-described third groove portion 4 which provides truer deformation along the foot in the running motion. Also, there may be disposed a second assist groove portion 5, which is an extension of the second groove portion 3 toward the middle-sole region. Further, there may be disposed a third assist groove portions 7, 8 in a direction extending from a toe-tip lateral side toward a center region of the shoe.

Hereinafter, a first embodiment of the sole 1, which is formed with the groove portions based on the demonstration described above, will be explained with reference to FIG. 15, FIG. 16 A and FIG. 16B.

Figure 15:
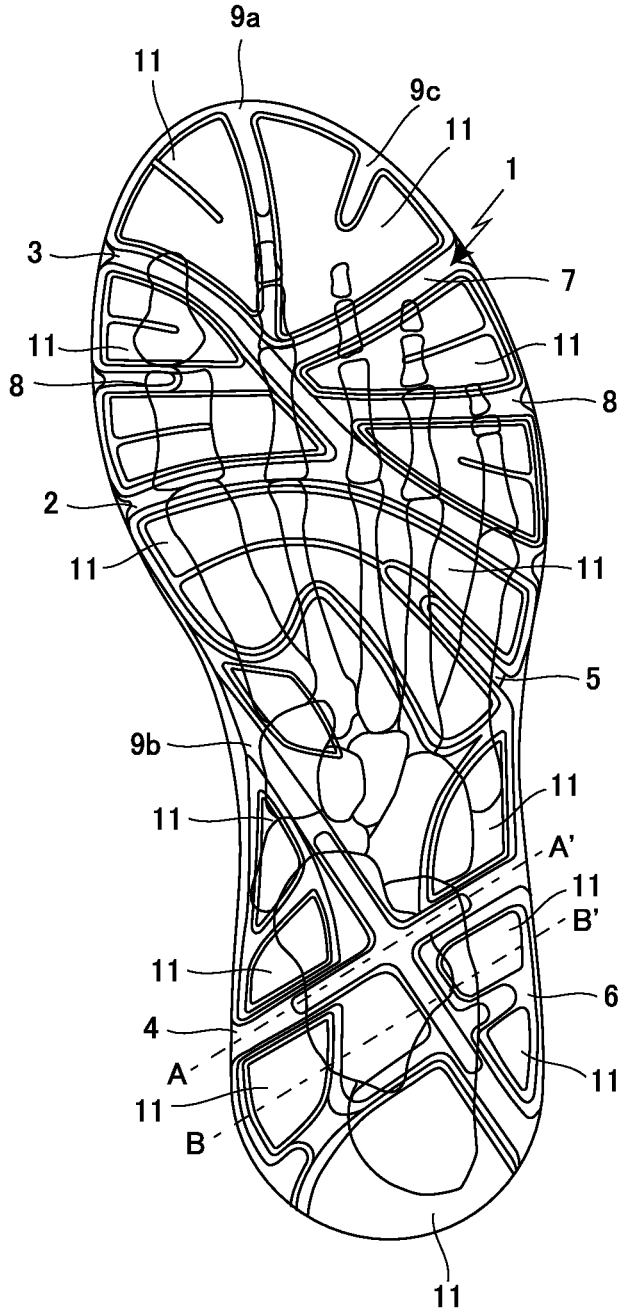
FIG. 15 is an explanatory view which shows a concept of the shoe sole according to the first embodiment of the present invention.

As shown in FIG. 15, the sole 1 includes an outer sole 11 having a landing surface which makes contact with a road surface, and a mid-sole 12 disposed on the outer sole 11. In this arrangement, the foot is supported in the fore-sole region F, the middle-sole region M and the rear-sole region R.

The outer sole 11 is made of a foamed or non-formed rubber for example, and has landing surfaces which make contact with a road surface.

Figure 16A:
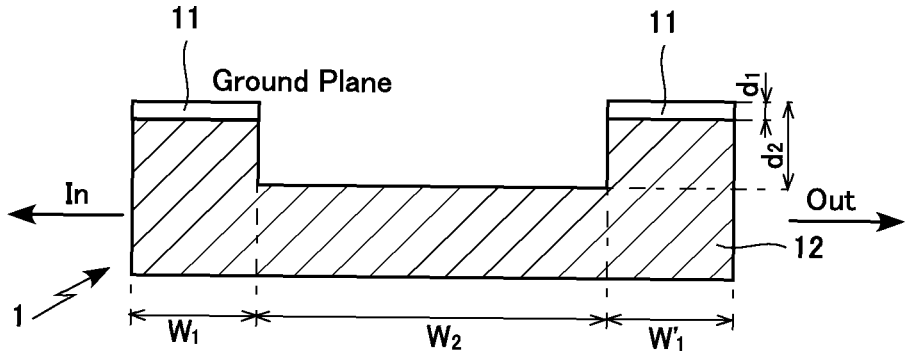
FIG. 16A is a sectional view taken in line A-A' in FIG. 15.
Figure 16B:
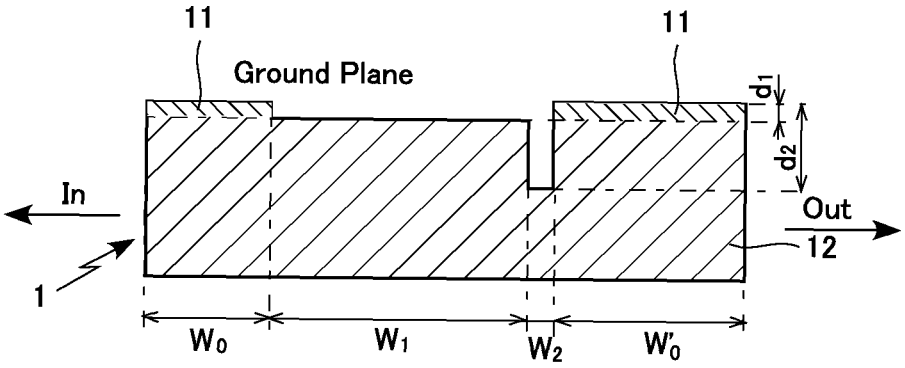
FIG. 16B is a sectional view taken in line B-B' in FIG. 15.

The mid-sole 12 is made of a formed resin provided by, e.g., EVA; disposed on the outer sole 11 as shown in FIGS. 16A and B; and absorbs landing shock. For this purpose, the mid-sole 12 is thicker than the outer sole 11.

In this sole 1, the earlier-described first groove portion 2, second groove portion 3 and third groove portion 4 are provided, and in addition, the first assist groove portion 6 is provided at a location more rearward than the third groove portion 4, in parallel with the third groove portion 4. Further, there is provided the second assist groove portion 5 as an extension of the second groove portion 3 toward the middle-sole region, and also the third assist groove portions 7, 8 are provided in a direction extending from a toe-tip lateral side toward a center region of the shoe. These groove portions 2 through 8 correspond to flexion axes in running motion.

The mid-sole 12 is provided with the groove portions 2 through 6, and groove portions 9*a*, 9*b*, 9*c* which will be described later. The outer sole 11 is disposed as a plurality of separate parts.

Each of the groove portions 2 through 6 have a deeper average depth than other groove portions. The groove portions in this average depth calculation were measured along their sections which were taken in such a fashion as in a sectional view taken in line A-A' and a sectional view taken in line B-B' in FIG. 15, i.e., in parallel with respective sections of the groove portions 2 through 6, from a medial side to the lateral side. In other words, the comparisons are made using sections taken in parallel with the groove portions 2 through 6 to evaluate a depth functioning as the flexion groove.

It should be noted here that the embodiment shown in FIG. 15 is provided with diagonal groove portions 9*a*, 9*b*, and 9*c* for a purpose of reducing weight of the sole 1. These groove portions do not have much influence on torsional rigidity. Also, FIG. 15 does not show any fine grooves (so called esthetic design) formed in the landing surface of the outer sole 11.

For the sole according to the present embodiment, the following mathematical expressions are used to calculate the average depths of the groove portions. As shown in FIG. 15, the A-A' section shows a section of the groove portion 4, whereas the B-B' section includes the groove 9*b* which is not one of the groove portions according to the present invention. Differences are shown in FIG. 16A and FIG. 16B.

The average groove depth of the groove portion 4 in the A-A' section indicated in FIG. 15 are calculated on the bases of Mathematical Expression 1. As shown in FIG. 16A, the groove portion 4 is deeper in a central area of the sole 1 than in end areas. The outer sole 11 is not provided in areas of predetermined widths ($W_1$, $W_1'$) on the inner and the lateral sides of the sole 1, so the groove is deeper by that thickness $d_1$, than the landing surface. In the central area between the two end areas, a groove is formed in the mid-sole 12, which makes the groove deeper than the landing surface by a depth $d_2$.

The average groove depth in the B-B' section which includes the groove portion 9*b* shown in FIG. 15 is calculated on the basis of Mathematical Expression 2. As shown in FIG. 16 B, in the B-B' section, the outer sole 11 is provided in areas of predetermined widths ($W_0$, $W_0'$) on the inner and the lateral sides of the sole 1, whereas the outer sole 11 is not provided in an area of a predetermined width ($W_1$) on a more central side, so the groove is deeper by that thickness $d_1$, than the landing surface. In the groove portion 9*b*, a groove is formed in the mid-sole 12, which makes the groove deeper than the landing surface by a depth $d_2$.

[MATH 1]

$$D_{ave} = \frac{w_1 + w_1'}{w} d_1 + \frac{w_2}{w} d_2$$

$$w = w_1 + w_1' + w_2$$

[MATH 2]

$$D_{ave} = \frac{w_0 + w_0'}{w} d_0 + \frac{w_1}{w} d_1 + \frac{w_2}{w} d_2$$

$$(d_0 = 0)$$

$$w = w_0 + w_0' + w_1 + w_2$$

The average depth of each groove portion provided in the sole 1 is calculated on the bases of Mathematical Expression 3.

[MATH 3]

$$D_{ave} = \sum_{i=0}^{n} \frac{w_i}{w} d_i$$

$$w = \sum_{i=0}^{n} \frac{w_i}{w} d_i$$

According to the sole provided by the present invention, an average depth of each groove portion is calculated on the basis of Mathematical Expression 3, and the second the groove portion 3 has the largest average depth of all average depths calculated for the other groove portions disposed in the fore-sole region F.

In addition, the first groove portion 2 has an average depth which is smaller than that of the second groove portion 3 but larger than average depths of the other grooves disposed in the fore-sole region F.

The third groove portion 4 has the deepest average depth of all average depths in any of the grooves disposed in the rear-sole region R.

Each of the groove portions 2, 3, 4 preferably has a depth of 5 mm through 10 mm, for example, at its deepest point. If the depth is too shallow, the groove does not provide sufficient flexion; if the depth is too much, on the other hand, the groove does not offer stable support to the foot.

Each of the groove portions 2, 3, 4 preferably has a width of 5 mm through 15 mm, for example. If the width is too wide, torsional rigidity decreases excessively; if the width is too narrow, on the other hand, the groove does not provide sufficient advantages such as flexion.

At a minimum, the sole according to the present embodiment is capable of flexing with the foot while restraining excessive pronation during running activities due to the arrangement that the above-described first groove portion 2, second groove portion 3 and third groove portion 4 are provided in the sole 1, and each of these groove portions has the deepest average depth of all average depths of the other groove portions located in the same region, whereby groove portions are provided at locations corresponding to the main flexion axis.

The groove portions are not limited to those extending from the medial end portion to the lateral end portion of the sole 1; for example, the groove portion may be an intermittent line of grooves consisting of a plurality of short grooves.

During the phases when the sole 1 flexes significantly at locations corresponding to the groove portion 4 and the groove portion 3, a load acts on the entire sole of the foot. The fore-sole region F and the rear-sole region R have different areas of contact with the foot in the sole 1; specifically, the fore-sole region F has a larger area of contact. For this reason, when the both regions receives a similar amount of load, the area which has a larger area of contact, i.e., the fore-sole region has a smaller pressure. In consideration of this, in the sole according to the present embodiment, there is a specific arrangement for a ratio of the depth (height) of each groove portion to the thickness of the sole 1; the second the groove portion 3, which is the flexion groove in the fore-sole region F has a greater ratio than the third the groove portion 4, which is the flexion groove in the rear-sole region R. This makes it possible to provide a uniform level of flexibility in the sole 1 which is made of regions having different pressure levels.

One characteristic of the sole according to the present embodiment is that the first groove portion 2, the second groove portion 3, and the third groove portion 4 are provided not simply at places corresponding to flexing areas of the foot sole, but along the actual flexion axes in the sole observed when running in shoes, i.e., in the process of landing on the ground to leaving the ground. These main flexion axes appears in the sole were discovered for the first time through three-dimensional measurement of the sole as has been described earlier, with the use of a motion capture system.

Figure 17A:
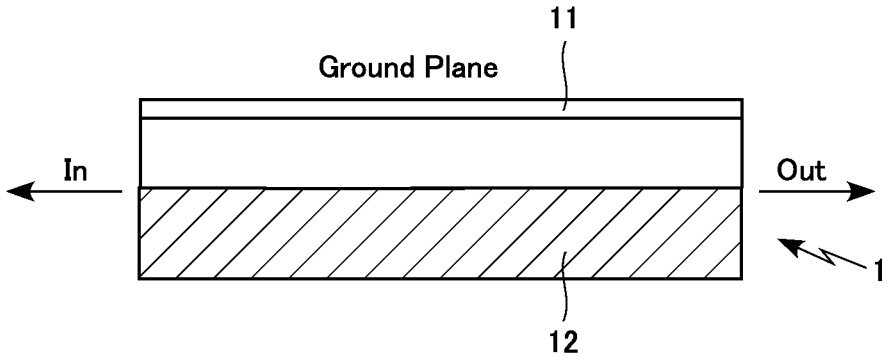
FIG. 17A is an explanatory view of an area corresponding to the A-A' section in FIG. 15 which shows an example of a groove portion in the first embodiment according to the present invention.
Figure 17B:
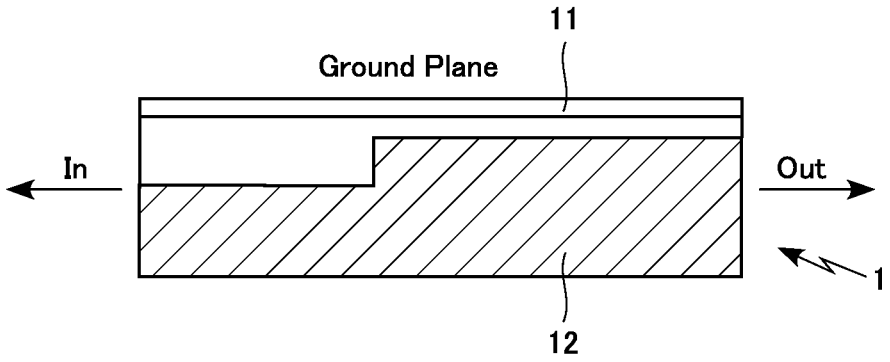
FIG. 17B is an explanatory view of an area corresponding to the A-A' section in FIG. 15 which shows an example of a groove portion in the first embodiment according to the present invention.

The groove portion 3 and the groove portion 4 may have a consistent depth from the medial side to the lateral side of the sole 1 as shown in the explanatory view in FIG. 17A, or may be as shown in FIG. 17B for example, i.e., the depth may be varied within the same groove portion in the mid-sole 12. Specifically, the groove portion shown in FIG. 17B is deeper on the medial side than on the lateral side.

In the middle phase of the support period when the groove portion 4 and the groove portion 3 show large deformation, a larger amount of load is placed on the lateral side of the middle-sole region which is faced by the tuberosity of fifth metatarsal. By making the medial side of the groove portion 4 deeper than the lateral side thereof as shown in FIG. 17B, it becomes possible to achieve a uniform deformation state on the inner and the lateral sides in the groove 4.

Figure 17C:
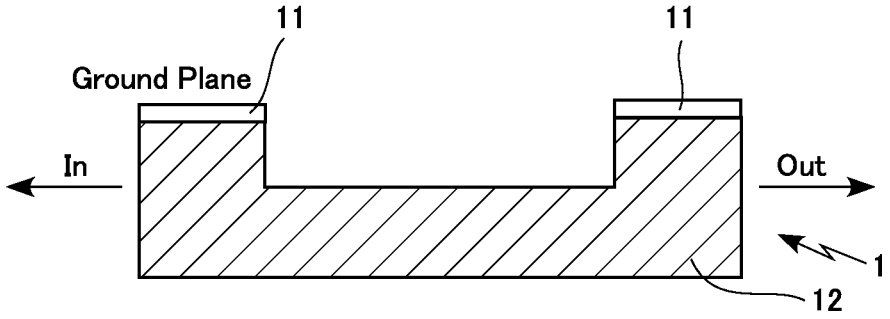
FIG. 17C is an explanatory view of an area corresponding to the A-A' section in FIG. 15 which shows an example of a groove portion in the first embodiment according to the present invention.
Figure 18:
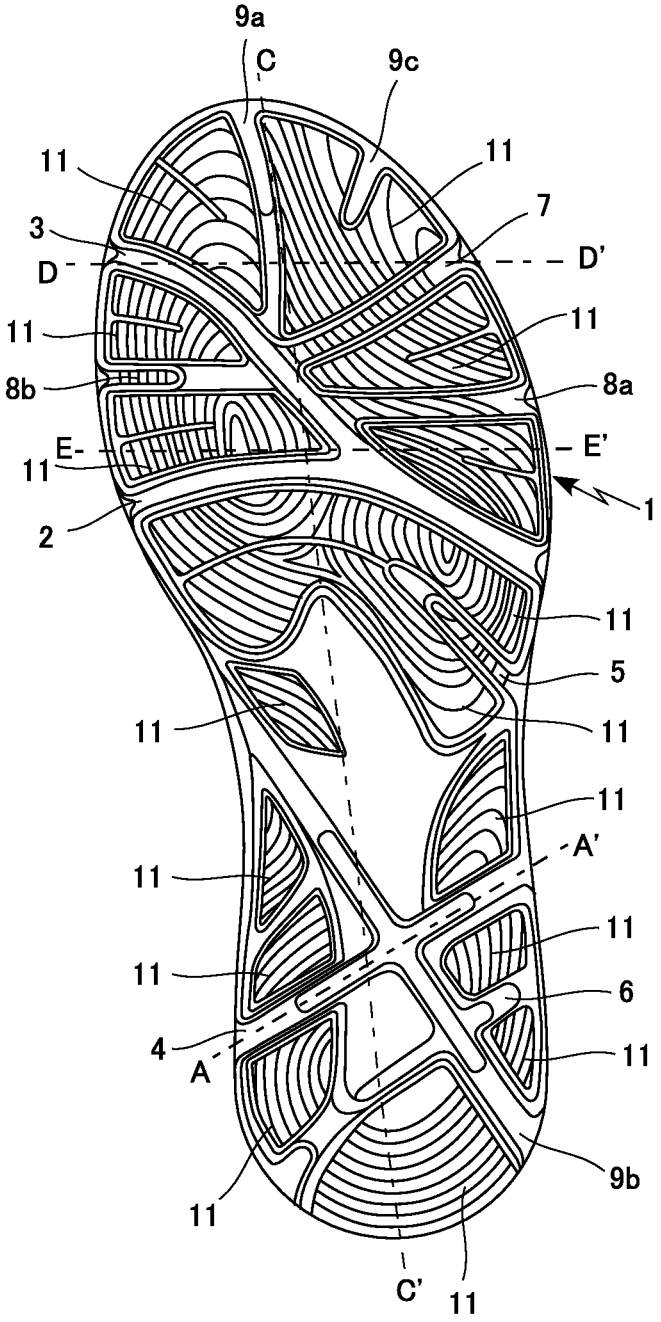
FIG. 18 is an explanatory view which shows a concept of the shoe sole according to a second embodiment of the present invention.

Also, as shown in FIG. 17C, the depth of the groove may be made shallower near an outer circumferential end of the groove portion 4. Specifically, the outer circumferential area of the groove portion 4 does not have the outer sole 11, so the groove in this area is shallower. This makes it possible to avoid excessive deformation of the sole 1 particularly when the heel is landing. The arrangement is expected to provide such an advantage as improved durability.

Next, a second embodiment of the present invention will be described with reference to FIG. 18 through FIG. 23.

Whereas the first embodiment uses amid-sole 12 of a single layer, in the second embodiment, a mid-sole 12 has two layers provided by a mid-sole 12*a* on the side closer to an upper 13 and a mid-sole 12*b* on the side closer to the outer sole 11.

In the second embodiment, the landing surface side of the sole 1 is provided, like in the first embodiment, with the first groove portion 2, the second groove portion 3 and the third groove portion 4.

Figure 19:
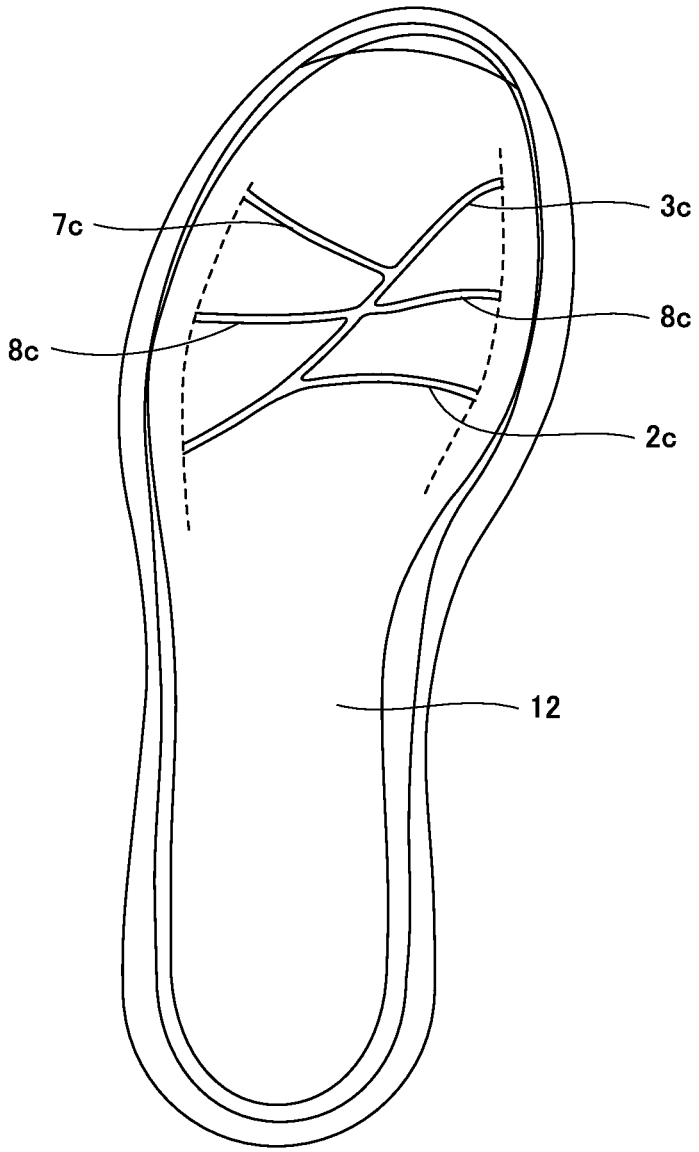
FIG. 19 is an explanatory view which shows a midsole of a shoe sole according to the second embodiment of the present invention.

In addition to these groove portions on the landing surface side, the sole according to the second embodiment has, as shown in FIG. 19, groove portions 2*c*, 3*c* at locations opposing the first groove portion 2 and the second groove portion 3, and other groove portions 7*c*, 8*c*, on an upper surface side of the mid-sole 12*a* which is the mid-sole on the side closer to the upper 13.

Figure 20:
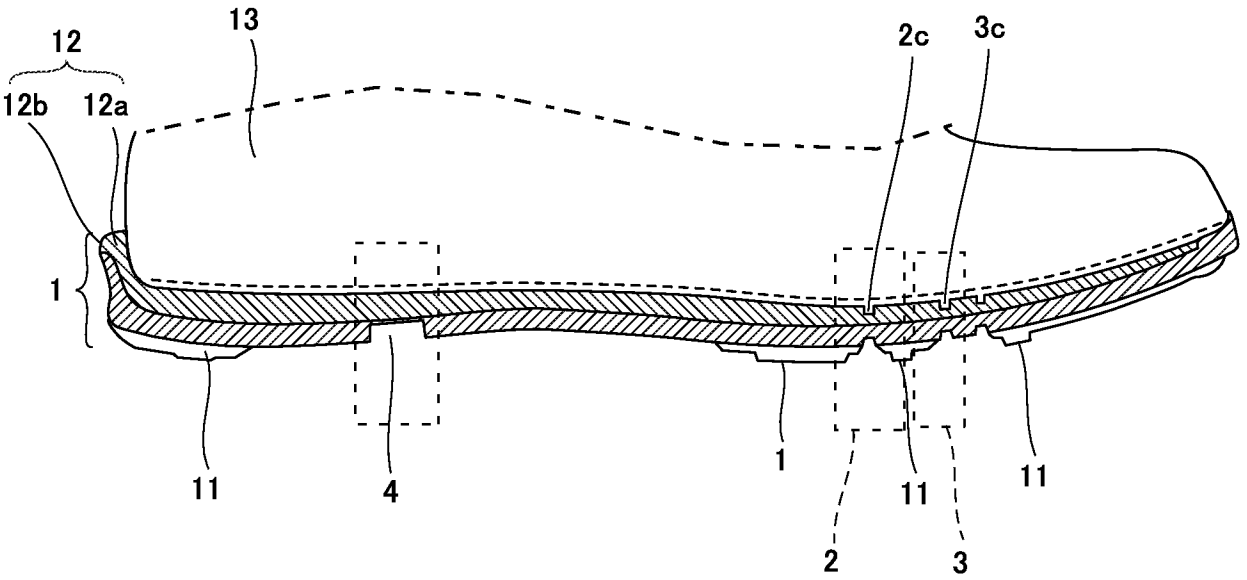
FIG. 20 is a sectional view taken in line C-C' in FIG. 18.
Figure 21:
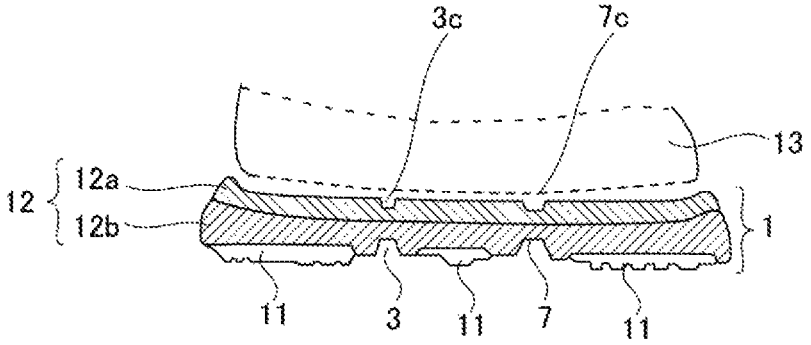
FIG. 21 is a sectional view taken in line D-D' in FIG. 18.
Figure 22:
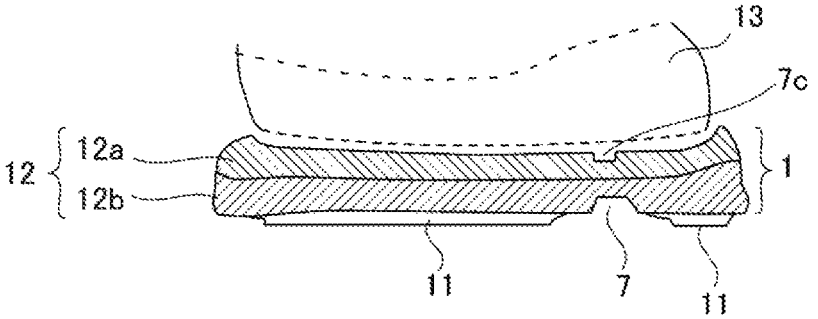
FIG. 22 is a sectional view taken in line E-E' in FIG. 18.
Figure 23:
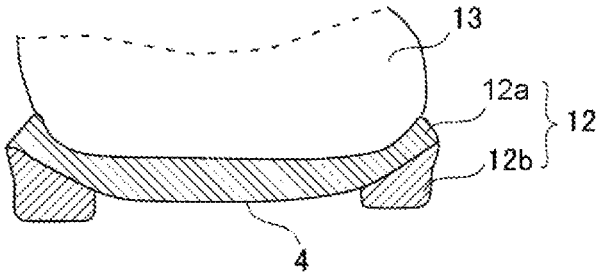
FIG. 23 is a sectional view taken in line A-A' in FIG. 18.

The groove portions provided on the outer sole 11 side of the mid-sole 12 and the groove portions provided on the upper 13 side in an opposing manner thereto are separated from each other as shown in FIG. 20 by the mid-sole 12.

In cases where the sole's upper surface side is provided with groove portions opposed to the groove portions on the landing surface side, the "ratio of the depth of the groove portion" refers to a ratio of a total depth of the mutually opposed grooves to the entire thickness of the sole. For example, in the second embodiment, the ratio of the depth of the second groove portion 3 to the thickness of the sole is: with the sole thickness in close vicinity of the second groove portion 3 being 12 mm, and a total thickness of the second groove portion 3 and the groove portion 2*c* opposed thereto being 7.5 mm, 62.5% (=7.5 mm/12 mm). On the other hand, the third groove portion 4 does not have a counter-part groove portion at an opposite location thereto. In this case, the ratio of the depth of the third groove portion 4 to the sole thickness is: with the sole thickness in close vicinity of the third groove portion 4 being 16 mm, and the depth of the third groove portion 4 being 9.5 mm, 59.4% (=9.5 mm/16 mm). In other words, the second groove portion 3 has a greater groove depth ratio to the sole thickness than the third groove portion 4.

It should be noted here that the term sole thickness refers to a dimension between the landing surface (area without a design) of the outer sole 11 and an upper surface of the mid-sole 12.

As has been mentioned in the description of the conventional examples, making grooves in various regions within the sole is not new; however, in any of the conventional arrangements, there has not been a principle, unlike in the present invention, that groove portions are disposed only at appropriate locations within the sole 1 for achieving both purposes of allowing for natural movement of the foot and reducing physical burden onto the body.

In running shoes and walking shoes, a common arrangement for restraining pronation is to increase sole rigidity. Also, a common arrangement to achieve natural movement of the foot is to decrease sole rigidity by employing such a means as providing a large number of grooves in the sole. However, according to the sole provided by the present embodiment, groove portions are provided only at appropriate locations within the sole 1, thereby achieving natural movement of the foot while maintaining the rigidity. Therefore, the invention allows the runner to run in his/her natural movement of the foot while restraining excessive pronation.

Figure 24:
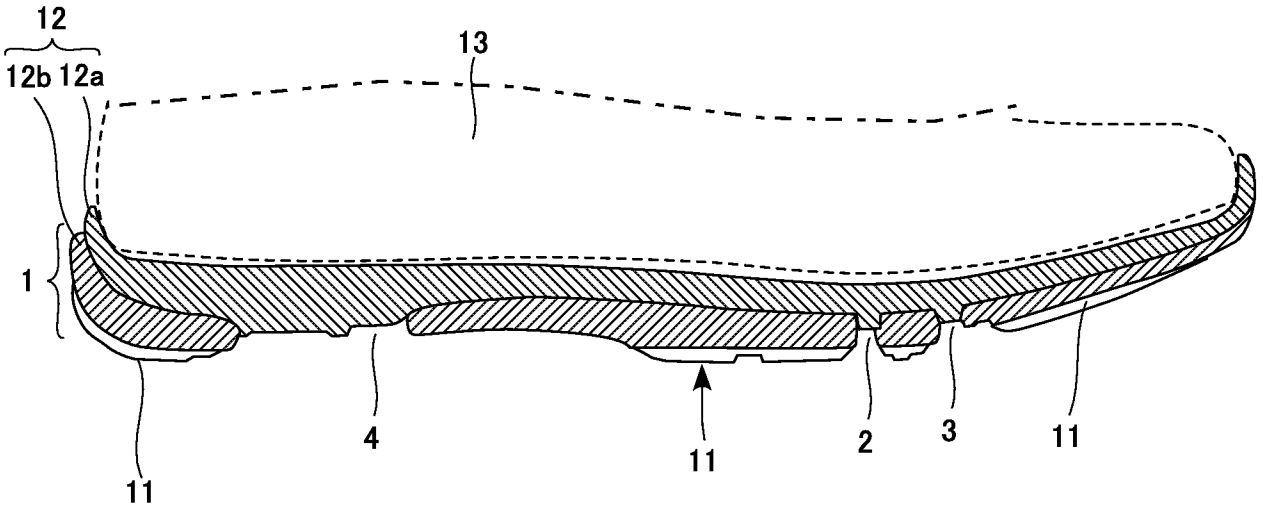
FIG. 24 is an explanatory view which shows a concept of the shoe sole according to a third embodiment of the present invention.
Figure 25:
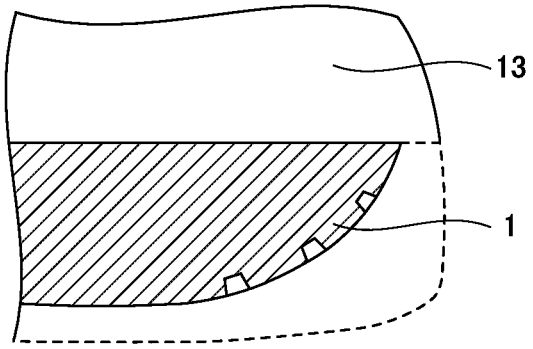
FIG. 25 is an explanatory view which shows a concept of the shoe sole according to the third embodiment of the present invention, representing an area corresponding to the A-A' section in FIG. 14.

Next, a third embodiment of the present invention will be described with reference to FIG. 24 and FIG. 25. FIG. 25 is a sectional view of the sole 1 corresponding to the one taken in a line A-A' in FIG. 14.

In the third embodiment, the thickness of the sole 1 in the rear-sole region is increasingly thinner as shown in FIG. 25, in a direction toward an obliquely lateral side in a plan view.

In bare-foot running, there is a tendency that landing begins with a lateral side of the rear-sole region, rather than a central area of the rear-sole region. Accordingly therefore, thinning from the lateral side of the rear-sole region may be made on a sole end surface, whereby it is possible to achieve a COP which is closer to that of bare-foot running. This helps achieve the landing feeling in bare-foot running on sponge.

All of the embodiments disclosed herein are to show examples, and should not be considered as of a limiting nature in any way. The scope of the present invention is identified by the claims and is not by the descriptions of the embodiments given hereabove, and it is intended that the scope includes all changes falling within equivalents in the meaning and extent of the claims.

INDUSTRIAL APPLICABILITY

The present invention is applicable to shoe soles of such shoes as running shoes and walking shoes.

REFERENCE SIGNS LIST

1: Sole
2: First Groove Portion
3: Second Groove Portion
4: Third Groove Portion
11: Outer Sole
12: Midsole
13: Upper

The invention claimed is:

1. A shoe sole which has a landing surface composed of three regions of a middle-sole region, a fore-sole region and a rear-sole region, and has a plurality of grooves in the landing surface, these sole regions being arranged in a longitudinal direction, which is along a toe to a heel of the shoe sole, wherein the grooves include:

a first groove located in the fore-sole region, on a first imaginary line($VL_1$) that is configured to extend along metatarsal-phalangeal joints of a wearer;

a second groove located in the fore-sole region, on a second imaginary line ($VL_2$) extending along a line which connects a medial outer edge of the fore-sole region and a lateral outer edge of the middle-sole region with each other, in an area which is closer to a toe portion of the shoe sole than to the first groove, the medial outer edge and the lateral outer edge being determined in a lateral direction of the shoe sole perpendicular to the longitudinal direction; and a third groove located on a third imaginary line ($VL_3$) extending along a line which connects a medial outer edge of the rear-sole region and the lateral outer edge of the middle-sole region with each other, the third groove stretching over the middle-sole region and the rear-sole region; wherein the second groove has a largest average depth of all average depths of the other grooves disposed in the fore-sole region, the third groove has a largest average depth of all average depths of the other grooves disposed in the rear-sole region, the first imaginary line is formed by connecting two MP intersections, one ($IP_{x1}$) of which being a spot where an extension of the first imaginary line intersects the medial outer edge of the fore-sole region and the other ($IP_{x2}$) of which being a spot where an extension of the first imaginary line intersects the lateral outer edge of the fore-sole region the second imaginary line is formed by connecting a first intersection ($IP_1$) and a second intersection ($IP_2$), the first intersection being positioned on the medial outer edge of the fore-sole region, further configured to be located within a range between the head of either first metatarsal bone or second metatarsal bone, which is closer to the heel of the shoe sole than the other, and the head of either first distal phalanx bone or second distal phalanx bone, which is longer than the other, of the wearer in the longitudinal direction, the second intersection being positioned on the lateral outer edge of the middle-sole region, further configured to be located within a range between the base and head of fifth metatarsal bone of the wearer in the longitudinal direction, the third imaginary line crosses the medial outer edge of the rear-sole region at an intersection ($IP_3$) that is configured to be located in a range of the subtalar joint of the wearer; and crosses the lateral outer edge of the middle-sole region at an intersection ($IP_4$) that is configured to be located in a range from the tuberosity of fifth metatarsal bone to the subtalar joint heel-side end of the wearer, and an entirety of the middle-sole region is composed with only either a mid-sole, which is made of foamed resin, or a combination of an outer sole and the mid-sole that is disposed on the outer sole such that the outer sole is configured to make a contact with a road surface wherein the outer sole is made of rubber, the mid-sole is thicker than the outer sole in up-down direction.

2. The shoe sole according to claim 1, wherein the average depth of the first groove is shallower than the average depth of the second groove but deeper than average depths of the other grooves disposed in the fore-sole region.

3. The shoe sole according to claim 1, wherein the depth of the second groove to a thickness of the shoe sole has a greater ratio than a ratio of the depth of the third groove to the thickness of the shoe sole.

4. The shoe sole according to claim 3, wherein the ratio of the depth of the second groove to the thickness of the shoe sole is not smaller than a ratio of the depth of the first groove to the thickness of the shoe sole.

5. The shoe sole according to claim 1, wherein the third groove is deeper on its medial side than on its lateral side.

6. The shoe sole according to claim 1, wherein the third groove is shallower near a medial outer circumferential end and near a lateral outer circumferential end than near its center.

7. The shoe sole according to claim 1, wherein the thickness of a heel portion of the shoe sole is gradually thinner in an obliquely outer direction in a plan view.

8. The shoe sole according to claim 1, wherein the second groove extends from the medial outer edge of the fore-sole region to the first groove in a substantially straight line and crosses the first groove, and a width of the second groove is defined with a pair of edges arranged on the landing surface in parallel along the second imaginary line such that an intermediate area between the edges is configured not to make a contact with the road surface and an outside area off the edges is configured to make a contact with the road surface when the shoe sole lands on the road surface.

9. The shoe sole according to claim 1, wherein the first groove is formed entirely between the MP intersections across the middle-sole region, and a width of the first groove is defined with a pair of edges arranged on the landing surface in parallel along the first imaginary line such that an intermediate area between the edges is configured not to make a contact with the road surface and an outside area off the edges is configured to make a contact with the road surface when the shoe sole lands on the road surface.

10. The shoe sole according to claim 9, wherein the second groove forms an acute angle with a medial side of the first groove.

11. The shoe sole according to claim 10, wherein the second groove is formed entirely from the first intersection to the first groove.

12. The shoe sole according to claim 1, wherein the first intersection ($IP_1$) of the second imaginary line is configured to be further located in a range between the head and the base of first distal phalanx in the longitudinal direction.

13. The shoe sole according to claim 1, wherein the third groove is formed with a constant width, the width of the third groove is defined with a pair of edges arranged on the landing surface in parallel along the third imaginary line such that an intermediate area between the edges is configured not to make a contact with the road surface and an outside area off the edges is configured to make a contact with the road surface when the shoe sole lands on the road surface.

14. The shoe sole according to claim 1, wherein the third groove extends from the intersection ($IP_3$) crossing the medial outer edge up to the intersection ($IP_4$) crossing the lateral outer edge.

15. The shoe sole according to claim 1, wherein the second groove does not extend beyond the first groove toward a heel portion of the shoe sole on the second imaginary line such that a remaining area in the second imaginary line where the second groove is not present is configured to make a contact with the road surface when the shoe sole lands on the road surface.

16. A shoe sole which has a landing surface composed of three regions of a middle-sole region, a fore-sole region and a rear-sole region, and has a plurality of grooves in the landing surface, these sole regions being arranged in a longitudinal direction, which is along a toe to a heel of the shoe sole, wherein the grooves include:

a first groove located in the fore-sole region, on a first imaginary line($VL_1$) that is configured to extend along metatarsal-phalangeal joints of a wearer;

a second groove located in the fore-sole region, on a second imaginary line ($VL_2$) extending along a line which connects a medial outer edge of the fore-sole region and a lateral outer edge of the middle-sole region with each other, in an area which is closer to a toe portion of the shoe sole than to the first groove, the medial outer edge and the lateral outer edge being determined in a lateral direction of the shoe sole perpendicular to the longitudinal direction; and a third groove located on a third imaginary line ($VL_3$) extending along a line which connects a medial outer edge of the rear-sole region and the lateral outer edge of the middle-sole region with each other, the third groove stretching over the middle-sole region and the rear-sole region; wherein the second groove has a largest average depth of all average depths of the other grooves disposed in the fore-sole region, the third groove has a largest average depth of all average depths of the other grooves disposed in the rear-sole region, the first imaginary line is formed by connecting two MP intersections, one ($IP_{x1}$) of which being a spot where an extension of the first imaginary line intersects the medial outer edge of the fore-sole region and the other ($IP_{x2}$) of which being a spot where an extension of the first imaginary line intersects the lateral outer edge of the fore-sole region, the second imaginary line is formed by connecting a first intersection ($IP_1$) and a second intersection ($IP_2$), the first intersection being positioned on the medial outer edge of the fore-sole region, further configured to be located within a range between the head of either first metatarsal bone or second metatarsal bone, which is closer to the heel of the shoe sole than the other, and the head of either first distal phalanx bone or second distal phalanx bone, which is longer than the other, of the wearer in the longitudinal direction, the second intersection being positioned on the lateral outer edge of the middle-sole region, further configured to be located within a range between the base and head of fifth metatarsal bone of the wearer in the longitudinal direction, the third imaginary line crosses the medial outer edge of the rear-sole region at an intersection ($IP_3$) that is configured to be located in a range of the subtalar joint of the wearer;

crosses the lateral outer edge of the middle-sole region at an intersection ($IP_4$) that is configured to be located in a range from the tuberosity of fifth metatarsal bone to the subtalar joint heel-side end of the wearer, and a first assist groove is located in the rear-sole region, on a side closer to a heel portion of the shoe sole than to the third groove wherein an intermediate area between the third groove and the first assist groove is configured to make a contact with a road surface when the shoe sole lands on the road surface, and the first assist groove is arranged in parallel with the third groove.

17. The shoe sole according to claim 16, further comprising a second assist groove located on the second imaginary line, in an area closer to the heel portion than to the first groove, and the second groove is not continuous to the second assist groove such that an intermediate area between the second groove and the second assist groove, which is on the second imaginary line, is configured to make a contact with the road surface when the shoe sole lands on the road surface.

18. The shoe sole according to claim 17, further comprising a third assist groove located in the fore-sole region and extending from the lateral outer edge of the fore-sole region toward a center area of the shoe.

19. The shoe sole according to claim 16, wherein the third groove extends from the intersection ($IP_3$) crossing the medial outer edge up to the intersection ($IP_4$) crossing the lateral outer edge, and a length of the first assist groove is shorter than a length of the third groove.

* * * * *